US005414903A

United States Patent [19]

Porteous

[11] Patent Number: 5,414,903

[45] Date of Patent: May 16, 1995

[54] SINGLE USE, DISPOSABLE DENTAL BIB HOLDER SYSTEM

[76] Inventor: Don D. Porteous, 600 E. Hueneme Rd., Oxnard, Calif. 93033

[21] Appl. No.: 59,077

[22] Filed: May 4, 1993

[51] Int. Cl.[6] ..... A41B 13/00; A44B 21/00

[52] U.S. Cl. ..... 24/9; 24/3.4; 24/300; 2/49.1

[58] Field of Search ..... 24/9, 7, 8, 3 B, 3 R, 24/115 F, 300, 301, 302, 598.4, 602; 119/857, 863, 865, 770; 224/202, 257, 258; 2/48, 49.1, 51

[56] References Cited

U.S. PATENT DOCUMENTS

| | | | |
|---|---|---|---|
| 211,479 | 1/1879 | Shelby | 24/9 |
| 675,108 | 5/1901 | Perkins | 24/9 |
| 868,817 | 10/1907 | Smith | 24/9 |
| 948,576 | 2/1910 | Frick | 24/9 |
| 1,720,295 | 7/1929 | Schwartzman | 24/300 |
| 2,430,941 | 11/1947 | Long | 2/49.1 |
| 2,709,812 | 6/1955 | Kanzow | 24/9 |
| 2,900,640 | 8/1959 | Haydu | 2/49.1 |
| 3,416,157 | 12/1968 | Marder et al. | 2/48 |
| 3,994,265 | 11/1976 | Banks | 119/865 |
| 4,277,863 | 7/1981 | Faneuf | 24/3 R |
| 4,646,365 | 3/1987 | Suprise et al. | 2/49 R |
| 5,027,477 | 7/1991 | Seron | 24/3 B |
| 5,244,135 | 9/1993 | Nelson | 24/3 B |

FOREIGN PATENT DOCUMENTS

| | | | |
|---|---|---|---|
| 2604609 | 4/1988 | France | 2/49.1 |

*Primary Examiner*—Victor N. Sakran
*Attorney, Agent, or Firm*—Louis J. Bachand

[57] ABSTRACT

For infection control in a dental operatory, a single use, disposable dental bib holder comprising a synthetic organic plastic strap of a length to go about the neck of a patient and having left and right terminals, left and right clip fasteners secured to the strap terminals and having interlocking portions for positively fastening a dental bib in use position, the strap being locally frangible between the terminals for manually separating the strap into two sections which are disposable with the dental bib.

15 Claims, 1 Drawing Sheet

FIG. 1
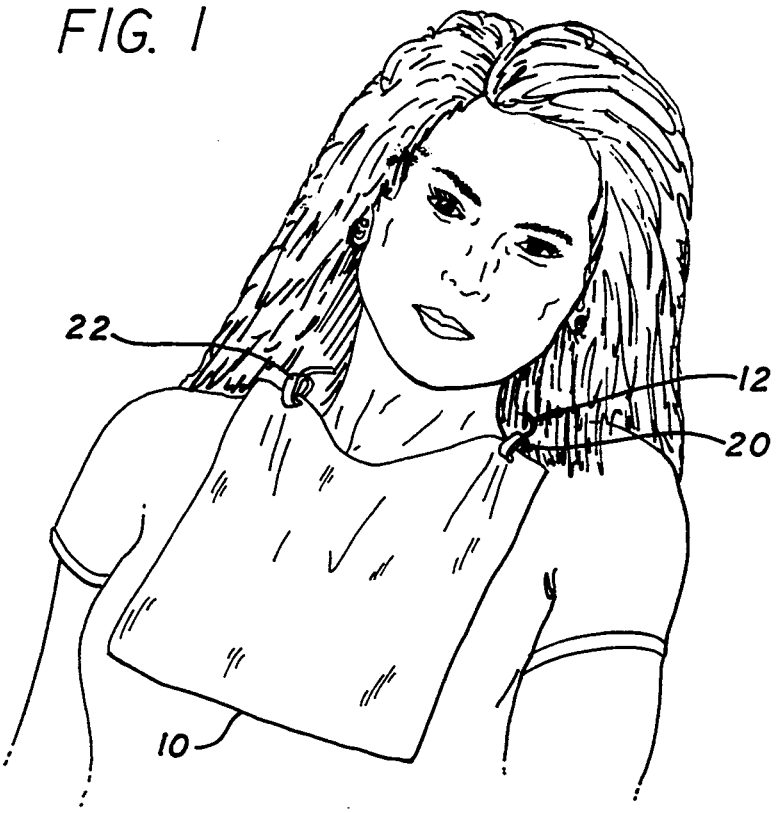
FIG. 2
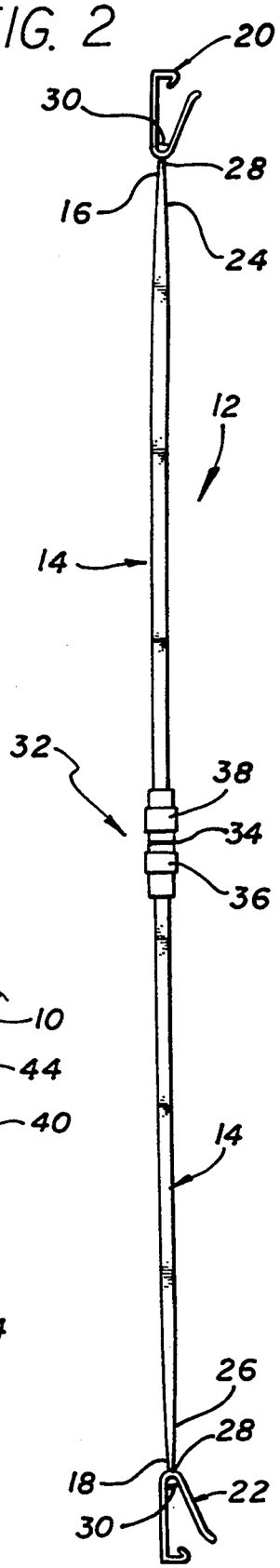
FIG. 3A
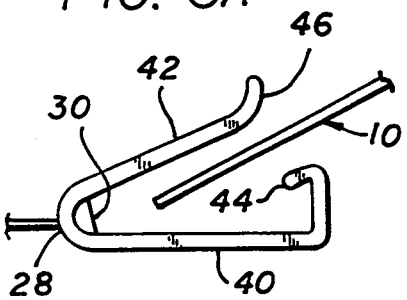
FIG. 3B
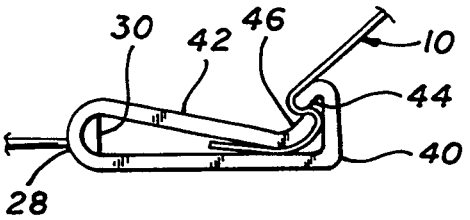
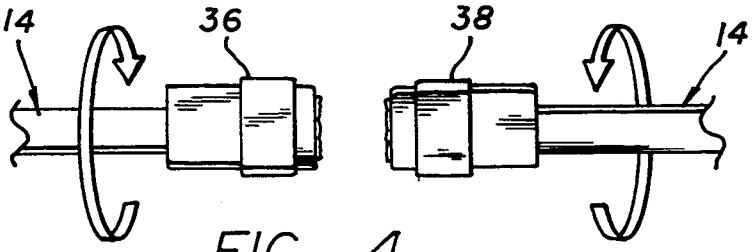
FIG. 4

SINGLE USE, DISPOSABLE DENTAL BIB HOLDER SYSTEM

TECHNICAL FIELD

This invention has to do with a holder for dental bibs, and more particularly, with improvements in systems for holding dental bibs on patients. The invention bib holder system includes clips and a strap therebetween which are disposable, made of lightweight plastic, sterilizable if needed, easily attached and easily removed, comfortable on the patient and which when used act as a safeguard against spread of infectious diseases in the dental operatory.

BACKGROUND

In the dental operatory, the dentist and her assistant protect the patient's clothing from dental detritus by placing a bib across the bosom of the patient. Heretofore, the bib, which is made of paper, plastic or a combination of plastic and paper, has been anchored in place by a strap circled around the nape of the patient's neck. In too many cases this strap has been a metal ball and link chain which while non-tangling and sufficiently strong is invariably cold and uncomfortable. Lately, a new concern has arisen about the widespread use of the ball and link type strap. It has been the practice to use and reuse these ball and link straps without intervening sterilization procedures, and in this time of infection consciousness such practices cannot continue. It is desirable to replace the ball and link straps with a disposable, one-use system, but the usability advantages of the ball and link devices must be retained.

SUMMARY OF THE INVENTION

It is an object therefore of the present invention to provide a new bib holder system for the securement of dental bibs on patients. It is another object to provide a low cost, single use strap system which is easily fastened to the bib, readily introduced about the neck of the patient, simply removed, and which has the added optional benefit of remaining connected to the used bib, to ensure disposal of bib holder, bib and all detritus after care of the patient is completed with a single toss into the medical waste trash.

These and other objects to become apparent hereinafter are realized in accordance with the invention by a single use, disposable dental bib holder comprising a synthetic organic plastic strap of a length to go about the neck of a patient and having left and right terminals, left and right fasteners secured to the strap terminals for fastening a dental bib in use position, the strap being locally frangible between the terminals for manually separating the strap into two sections which are disposable with the dental bib.

In this and like embodiments, the strap is relatively attenuated at the terminals for greater flexibility adjacent the clips, the strap is locally stiffened adjacent its locus of frangibility to make breaking of the strap easier, the strap locus of frangibility is located at the nape of the neck in use position of the strap, the fasteners each comprise a U-shaped clip with interlocking ends, the fastener clips further comprise opposed legs extending from a common base, the outer end of one leg being hooked to lock over the other leg in the received condition of a bib, whereby the bib is only difficultly removed from the clip, and the clip other leg is reversely deflected to the one leg hook to positively interlock therewith across a received bib.

In a more particularly preferred embodiment, there is provided in accordance with the invention a single use, disposable dental bib holder comprising a synthetic organic plastic strap of a length to go about the neck of a patient and having left and right terminals, left and right clip fasteners secured to the strap terminals and having interlocking portions for positively fastening a dental bib in use position, the strap being locally frangible between the terminals for manually separating the strap into two sections which are disposable with the dental bib.

In this and like embodiments, the strap is relatively attenuated at the terminals for greater flexibility adjacent the clips, the strap is locally stiffened on either side of its locus of frangibility to make breaking of the strap easier, the strap locus of frangibility is located at the nape of the neck in use position of the strap, the fasteners each comprise a U-shaped clip, the fastener clips further comprise opposed legs extending from a common base, the outer end of one leg being hooked to lock over the other leg in the received condition of a bib, whereby the bib is only difficultly removed from the clip, the clip other leg is reversely deflected in interlockable relation with the one leg to irremovably engage a received bib, and the clip fastener is formed of resilient plastic in a manner urging the opposed legs to remain locked once engaged.

The invention further contemplates, in combination: a dental bib, a strap, and a dental bib holder, the holder comprising a fastening clip having a generally U-shape with a base and opposed legs, formed of resilient plastic in a manner normally urging the legs apart, the clip legs having cooperating oppositely deflected ends for interlocking once engaged.

The invention further contemplates a dental bib holder comprising a fastening clip having a generally U-shape with a base and opposed legs, formed of resilient plastic in a manner normally urging the legs apart, the clip legs having cooperating oppositely deflected ends for interlocking once engaged.

BRIEF DESCRIPTION OF THE DRAWINGS

The invention will be further described as to an illustrative embodiment in conjunction with the attached drawings in which:

FIG. 1 is a pictorial view of the invention dental bib holder in use position on a patient;

FIG. 2 is a side elevation view of the dental bib holder strap and fastening clips;

FIG. 3A is a fragmentary view of the fastening clip open to receive a dental bib;

FIG. 3B is a view like FIG. 3A of the fastening clip closed upon a dental bib; and, FIG. 4 is a fragmentary view of the locus of frangibility of the dental bib holder strap, showing areas of localized stiffening and an attenuated web therebetween.

DETAILED DESCRIPTION

With reference now to the drawings in detail, in FIGS. 1 to 3B, a dental patient is shown, wearing dental bib 10 across the bosom, secured in place by a dental bib holder 12. The holder comprises a strap 14 having left and right terminals 16, 18 to which are affixed respectively fastening clips 20, 22. The strap 14 is attenuated at 24, 26 adjacent the respective fastening clips 20, 22 to facilitate rotation of the fastening clips in use on the dental bib 10 and to ensure that the bib lays flat. Fastening clips 20, 22 may be secured to the strap portions 24, 26 by having the strap enter the base 28 of the fastening clips and having within the clips a terminal boss 30 which blocks removal of the clip from the fastener clip base.

With reference to FIGS. 2 and 4, the strap 14 has a relatively frangible portion 32, typically located at the nape of the patient's neck for easy access by a dental professional, and defined by a reduced cross section web 34, and stiffened portions 36, 38 of the strap 14 on either side of the web. As shown in FIG. 4 the strap 14 is readily broken by twisting the strap stiffened portions 36, 38 oppositely. This ready fracturing of the strap 14 encourages the throwing away of the strap rather than reuse, and the throwing away thereof with the dental bib 10 attached as will be seen since it is not easy to separate the bib from the fastening clips 20, 22, especially in contrast to the ease of breaking the strap at web 34.

With reference to the fastening clips 20, 22 each is shown to comprise a generally U-shaped member having a base 28, and opposed legs 40, 42 which are normally open by virtue of their molding process, FIG. 3A, but which because of the resiliency of the plastic material from which they are made may be closed, FIG. 3B. The bib 10 is inserted between the clip fastener legs 40, 42 and the clip legs pressed together. The leg 40 has a hooked end portion 44, as shown, obtained by deflecting the leg inward at the outer end thereof. The leg 42 has an oppositely deflected and hooked end portion 46, as shown, obtained by deflecting the leg inward at the outer end thereof opposite to the deflection of the leg 40 outer end portion 44. The lengths of legs 40, 42 are unequal such that leg 42 outer end portion 46 will pass by leg 40 outer end portion 44 by slight mutual deflection and snap into place hooked behind end portion 44, The bib 10 is thus trapped in the fastener clip and typically cannot be removed without tearing.

Thus the single use goal is further met as it is more difficult to save the holder by removing the bib and reusing than to sever the strap at the back and toss away with the bib still attached.

I claim:

1. A single use, disposable dental bib holder comprising a synthetic organic plastic strap of a length to go about the neck of a patient and having left and right terminals, left and right fasteners secured to said strap terminals for fastening a dental bib in use position, said strap having a frangible, reduced cross section web portion between said terminals, said strap having increased cross section portions immediately adjacent and on either side of said web portion to stiffen said strap for fracturing mid web portion by twisting said increased cross section portions oppositely for manually separating said strap into two sections which are disposable with said dental bib.

2. The single use, disposable dental bib holder according to claim 1, in which said strap is locally stiffened adjacent its locus of frangibility to make breaking of said strap easier.

3. The single use, disposable dental bib holder according to claim 1, in which said strap locus of frangibility is located at the nape of the neck in use position of the strap.

4. The single use, disposable dental bib holder according to claim 1, in which said fasteners each comprise a U-shaped clip with interlocking ends.

5. The single use, disposable dental bib holder according to claim 4 in which said fastener clips further comprise opposed legs extending from a common base, the outer end of one leg being hooked to lock over the other leg in the received condition of a bib, whereby the bib is only difficultly removed from said clip.

6. The single use, disposable dental bib holder according to claim 5, in which said clip other leg is reversely deflected to said one leg hook to positively interlock therewith across a received bib.

7. A single use, disposable dental bib holder comprising a synthetic organic plastic strap of a length to go about the neck of a patient and having left and right terminals, left and right fasteners secured to said strap terminals for fastening a dental bib in use position, said strap being locally frangible between said terminals for manually separating said strap into two sections which are disposable with said dental bib, said strap being relatively attenuated at said terminals for greater flexibility adjacent said clips.

8. A single use, disposable dental bib holder comprising a synthetic organic plastic strap of a length to go about the neck of a patient and having integral left and right terminals, left and right clip fasteners secured to said strap terminals and having interlocking portions for positively fastening a dental bib in use position, said strap having integrally formed between said terminals a web portion of reduced cross section relative to said strap, said strap having a further integrally formed locally stiffened portion increased in cross section in two dimensions relative to said strap and located immediately adjacent said reduced cross section web portion for twist fracturing said web portion for manually separating said strap into two sections which are disposable with said dental bib.

9. A single use, disposable dental bib holder comprising a synthetic organic plastic strap of a length to go about the neck of a patient and having integral left and right terminals, left and right clip fasteners secured to said strap terminals and having interlocking portions for positively fastening a dental bib in use position, said strap having an integrally formed locally frangible locus between said terminals for manually separating said strap into two sections which are disposable with said dental bib, said strap being relatively attenuated at said terminals for greater flexibility adjacent said clips.

10. The single use, disposable dental bib holder according to claim 9, in which said strap is integrally locally stiffened adjacent its locus of frangibility to make breaking of said strap easier.

11. The single use, disposable dental bib holder according to claim 10, in which said strap locus of frangibility is located at the nape of the neck in use position of the strap.

12. The single use, disposable dental bib holder according to claim 10, in which said fasteners each comprise a U-shaped clip.

13. The single use, disposable dental bib holder according to claim 12 in which said fastener clips further comprise opposed legs extending from a common base, the outer end of one leg being hooked to lock over the other leg in the received condition of a bib, whereby the bib is only difficultly removed from said clip.

14. The single use, disposable dental bib holder according to claim 13, in which said clip other leg is reversely deflected in interlockable relation with said one leg to irremovably engage a received bib.

15. The single use, disposable dental bib holder according to claim 14, in which said clip fastener is formed of resilient plastic in a manner urging the opposed legs to remain locked once engaged.

* * * * *